US006212810B1

(12) United States Patent
Jones

(10) Patent No.: US 6,212,810 B1
(45) Date of Patent: Apr. 10, 2001

(54) POLE SYSTEM FOR DISPLAYING PICTURE FRAMES

(75) Inventor: Joseph W. Jones, Statesville, NC (US)

(73) Assignee: Intercraft Company, Freeport, IL (US)

( * ) Notice: Subject to any disclaimer, the term of this patent is extended or adjusted under 35 U.S.C. 154(b) by 0 days.

(21) Appl. No.: 09/305,632

(22) Filed: May 5, 1999

(51) Int. Cl.[7] ..... A47G 1/16

(52) U.S. Cl. ..... 40/757; 40/727; 40/761; 40/606; 248/121; 248/473; 248/495; 248/125.2; 248/125.7; 160/135

(58) Field of Search ..... 40/725, 727, 729, 40/730, 757, 761, 606, 607; 248/121, 473, 489, 495, 125.2, 125.7; 160/135

(56) References Cited

U.S. PATENT DOCUMENTS

| | | | | |
|---|---|---|---|---|
| 1,196,936 | * | 9/1916 | Elsass et al. | 248/495 |
| 1,290,809 | * | 1/1919 | Truax | 211/85.14 |
| 1,423,612 | * | 7/1922 | Jewett | 211/85.31 |
| 3,188,028 | * | 6/1965 | Waller | 248/489 |
| 3,285,549 | * | 11/1966 | Cook | 248/495 |
| 3,317,168 | * | 5/1967 | Ziph | 248/156 |
| 3,592,289 | * | 7/1971 | Aysta | 160/135 |
| 3,635,352 | * | 1/1972 | Brooks et al. | 211/47 |
| 3,638,894 | * | 2/1972 | Leutenegger | 248/230.1 |
| 4,508,300 | * | 4/1985 | Minick | 248/216.1 |
| 4,549,713 | * | 10/1985 | Magadini | 248/495 |
| 4,561,617 | * | 12/1985 | Hafner | 248/121 |
| 4,976,409 | * | 12/1990 | Hansen | 248/469 |
| 5,342,014 | * | 8/1994 | Wilson | 248/476 |
| 5,452,140 | * | 9/1995 | Kody | 359/871 |
| 5,560,418 | * | 10/1996 | Kissinger | 160/351 |

FOREIGN PATENT DOCUMENTS 4-67816 * 3/1992 (JP) .

OTHER PUBLICATIONS

Home Accents Today, Dec. 1998, p. 7 (photo display).

* cited by examiner

*Primary Examiner*—Terry Lee Melius
*Assistant Examiner*—Andrea Chop
(74) *Attorney, Agent, or Firm*—Foley & Lardner

(57) ABSTRACT

A pole system for displaying picture frames includes a pole, mounting devices for holding the pole in a vertical position, and a plurality of sliding elements movable along the length of the pole to positions selected by the user. Each sliding element includes a connector adapted to engage a sawtooth bracket, wire, hole or other structure on the back of a picture frame. A plurality of frames can be displayed from the pole, the spacing between each of them and their relative rotational position about the pole being easily and quickly changed by the user. In the most preferred embodiment, the mounting devices include brackets for suspending the pole in a spaced apart relationship from an office furniture panel, and the sliding elements are spring steel plates with a pair of openings adapted to fit over the pole when the plate is bent into a curved position. Movement of the plates along the length of the pole is quickly accomplished by urging the ends of the plate toward one another, moving the plate along the pole and then releasing the plate.

17 Claims, 4 Drawing Sheets

POLE SYSTEM FOR DISPLAYING PICTURE FRAMES

CROSS-REFERENCES TO RELATED APPLICATIONS, IF ANY

None

BACKGROUND OF THE INVENTION

1. Field of the Invention

The present invention relates generally to the field of picture frames and the display thereof, and more particularly to the display of a plurality of picture frames along the length of a vertical pole. In its most preferred embodiment, the present invention relates to a pole system for displaying picture frames along a pole coupled to but spaced apart from the vertical surface of an office furniture panel.

2. Description of the Prior Art

A large number of systems are known for displaying paintings, photographs and the like, and in recent years a large number of styles of picture frames have been manufactured and sold in many price categories and for many different display environments. Frames may be placed on a table, shelf, desk, or other horizontal surface, or frames may be hung on a vertical surface, such as a wall. For picture frames hung on a wall, the back of the frame is typically equipped with a wire, a circular opening on a tab or sawtooth shaped bracket, and a nail or other hanger is secured in the wall. The frame attachment component engages the wall component to suspend the frame at a desired location. With the frame wires and the sawtooth plates mentioned above, frame alignment is accomplished by moving the frame laterally, while with the tab attachment component on the back of the frame, alignment is automatic as the wall component comes to rest at the top center of the opening.

It is also known that a grouping of picture frames may be located on a vertical wall surface. One such system includes a wire rod mounted vertically on a wall, with four wire hooks fixed on the rod. each hook engages the bottom edge of a frame. This system is not adjustable with respect to hook or frame locations, and the rod is not supplied with any fastening means other than one which will secure the rod to a flat, vertical surface.

In recent years, a number of new work environments have appeared in offices, especially with the development of office furniture panels or "systems furniture" as those products are known in that art. Systems furniture is comprised of a plurality of reconfigurable vertical panels, which are typically arranged end to end and in perpendicular orientations to define individual workstations or cubicles.

While systems furniture provides great space efficiency, the resultant workstations are typically smaller than the offices which they replace and have less horizontal and vertical surfaces for the display of pictures or other aesthetic enhancements. Furthermore, with the ever-increasing use of computers, printers, and other technological marvels, less and less space is available for a worker to personalize a cubicle or add a calming effect by displaying pictures of family, favorite places, paintings or other art objects. Pinning or taping pictures to corkboards or to the decorative skins of systems furniture is frequently done, but the result is generally not aesthetically pleasing.

A system for displaying a plurality of picture frames which would be useful with systems furniture and in other home and office environments would represent a significant advance in the art.

FEATURES AND SUMMARY OF THE INVENTION

A primary feature of the present invention is to provide a pole system for displaying picture frames which is widely adaptable to a variety of end use applications.

Another feature of the present invention is to provide a pole system for displaying picture frames which may be used in cubicles or work spaces of offices, including cubicles or work stations defined by panels of systems furniture.

A different feature of the present invention is to provide a pole system for displaying picture frames in which the vertical spacing between the frames may be readily adjusted, preferably without the need for specialized tools or skills.

A further feature of the present invention is to provide a pole system for displaying picture frames in which the pole may be easily broken down into smaller lengths for ease of packaging and shipping and which may be easily and quickly assembled without specialized tools or skills.

A still further feature of the present invention is to provide a pole system for displaying picture frames which may be attached and/or detached easily and quickly from furniture panels without damaging the panels and without specialized tools or skills.

How these and other features of the present invention are accomplished will be described in the following detailed description of the preferred and alternate embodiments of the present invention, taken in conjunction with the FIGURES. Generally, however, the features are accomplished using an elongate, preferably cylindrical pole, having a length selected for a particular application. The pole is preferably of the type which includes an interior elastic cord and pole sections which telescope with one another so that the pole may be compactly stored and shipped. The pole includes attachment members for coupling the pole in a desired orientation, usually a vertical orientation. In the illustrated and preferred embodiment, the attachment members include brackets adapted to engage the top and bottom of system furniture panels. Sliding elements are provided for the pole, each of which includes a hook for receivably supporting a picture frame. In the preferred embodiment the sliding members are elongate plates which have a circular opening on either end. The plates are made from spring steel or other resilient material and are bent into an arcuate position to allow both openings to slide along the pole. When the sliding element is located at the desired place, the plate is released and the spring forces of the plate hold it in that location. The picture frame, which may include a wire tab, hole or sawtooth bracket on its rear side is then coupled to the hook of the sliding element. Other ways in which the objects of the present invention are accomplished will be described in the following portions of the specification, or will become apparent to those skilled in the art after they have read this specification and comprehend its teachings. Such other ways are deemed to fall within the scope of this invention if they fall within the scope of the claims which follow.

DESCRIPTION OF THE DRAWINGS

In the following drawings, like reference numerals are used to indicate like components.

DETAILED DESCRIPTION OF THE PREFERRED AND ALTERNATE EMBODIMENTS

Before proceeding to a description of the preferred and alternate embodiments of the invention, several general comments can be made with regard to the applicability and the scope thereof.

First, the nature of the pole can be widely varied. In the illustrated and preferred embodiment, the rod comprises a plurality of telescoping sections held together by the resilient forces of an elastic cord. However, the pole can be a single section and may be made in profiles other than circular in cross-section. The resiliency of the cord is particularly well suited for embodiments where a clamping force applied to mounting brackets may be desired, such as the top and bottom brackets used with systems furniture office panels.

Second, while the present invention is illustrated in its preferred form in connection with office furniture, the pole system for displaying picture frames can be used in other environments, and certain modifications necessary to make changes will become readily apparent to those skilled in the art after they have read the specification. For example, a pole may be provided with threaded openings at its upper and lower ends for receiving bolts extending from the center of bottom and top mounting plates. By suitable rotation of the plates, the distance between the plates will change and the pole can be secured in a vertical position between the floor and ceiling of a room.

Third, the materials of construction are also widely variable. Metal poles, or poles made from plastic resins are preferred, but wooden poles may also be used. Furthermore, the poles may be hollow or solid.

Fourth, two preferred types of sliding elements are illustrated in the following sections, flat plates and collars. Other types of sliding elements could also be employed, such as clothes pin type clips.

Fifth, the picture frame backing can also be any of those known to the art which are capable of cooperation with a hook on a the sliding element to hold the picture frame in a desired position. Applicant prefers to use the sawtooth brackets commonly found on the back of picture frames, but wires or tabs can also be used.

Sixth, the number of picture frames which may be provided on a single pole can vary widely and will depend in large part on the particular environment and on the size of the picture frames which will be used.

Seventh, the way in which mounting brackets are attached is not, in and of itself, part of the present invention. They may be welded or otherwise permanently attached to the rod or may be coupled thereto through openings, shoulders on the clips or rods, threaded fasteners on either side of the clip opening and the like. It will also be noted that finials are used in an illustrated embodiment, primarily for decorative purposes, and they may be of the type which include a collar which extends over the end of the pole or they may have a plug which is inserted into the end of the pole.

Figure 1:
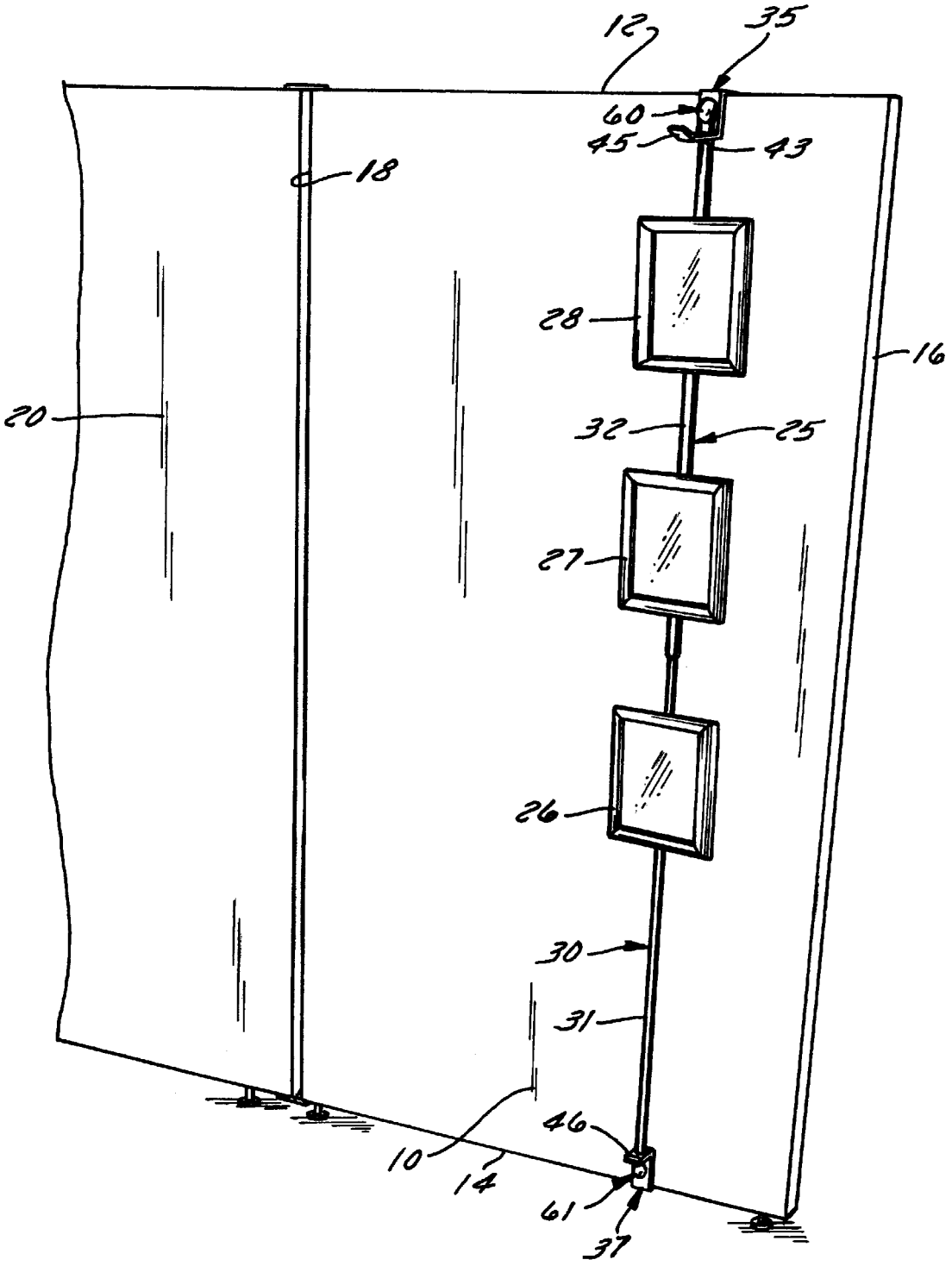
FIG. 1 is a perspective view of a pole system for displaying picture frames according to the preferred embodiment of the present invention and shown in the environment of a systems furniture workstation or cubicle.

Proceeding now to FIG. 1, an office furniture panel 10 is shown to include a top edge 12, a bottom edge 14, an outer edge 16 and an inner edge 18 coupled to an adjoining office panel 20. The pole system for displaying picture frames 25 is shown attached to the upper edge 12 and the bottom edge 14 near the outer edge 16 and to include three picture frames 26, 27 and 28. Greater detail concerning the preferred embodiment is found in FIG. 2, a side view of the pole system for displaying picture frames 25. A pole 30 is comprised of a first lower section 31 and a second upper section 32, the upper end of section 31 telescoping into the lower end of section 32. Picture frame 28 has been removed from this drawing for purposes of illustrating certain components.

The pole system for displaying picture frames 26, 27 and 28 also includes an upper mounting bracket 35 and a lower mounting bracket 37. Mounting bracket 35 includes a generally U-shaped portion 40 which has one leg which extends a greater distance than the other. The width of the U-shaped portion 40 is sufficient to pass over the top edge 12 of the panel 10. At the terminal end of the longer leg 42, an outwardly extending plate 43 is provided which in turn includes an up turned bend 45. A hole is provided through the plate 43. The lower mounting bracket 37 is similarly shaped and includes a U-shaped portion 38 having a longer leg portion 44, an outwardly extending plate 46 and a down turned bend 47.

Figure 2:
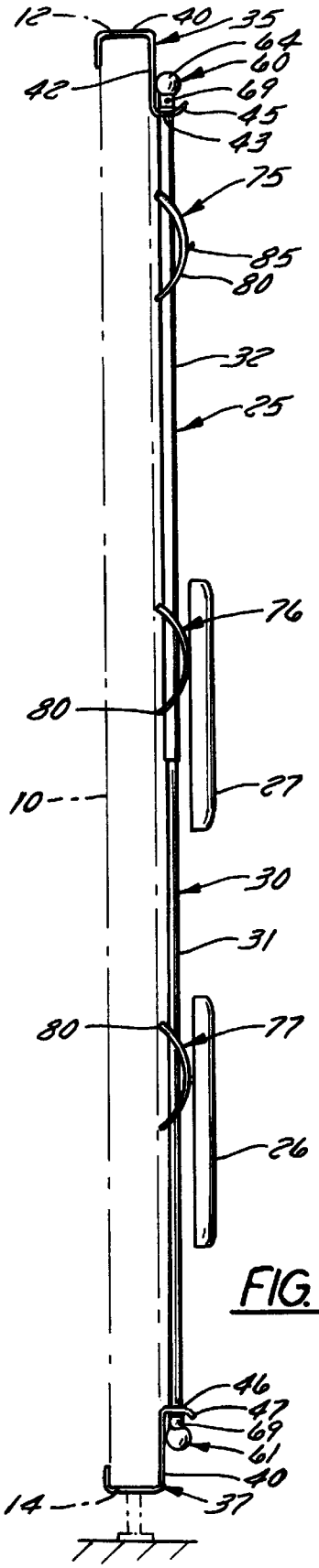
FIG. 2 is a side view of the pole, sliding elements and frame components shown in FIG. 1, partially in section, the pole being a two piece telescoping pole held on a systems furniture panel by the resilient forces of an elastic inner cord acting on upper and lower mounting brackets.

The sectional view of FIG. 2 shows that the lower portion 31 of pole 30 telescopes inside of section 32, thereby permitting the pole to be stored, packaged and shipped in one-half the length which would be required if the pole 30 were solid. Furthermore, an elastic cord 52 extends the length of pole 30 and is attached at the upper end of the pole to a elastic cord hook 54 and at the bottom of the pole to an elastic cord hook 55. Ideally, the cord would be relaxed when the two pole sections 31 and 32 are entirely nested and has sufficient resiliency to allow for extension of sections 31 and 32 for more than the full height of the office panel 10. The upper end of lower pole section 31 is identified by reference numeral 33.

Figure 2A:
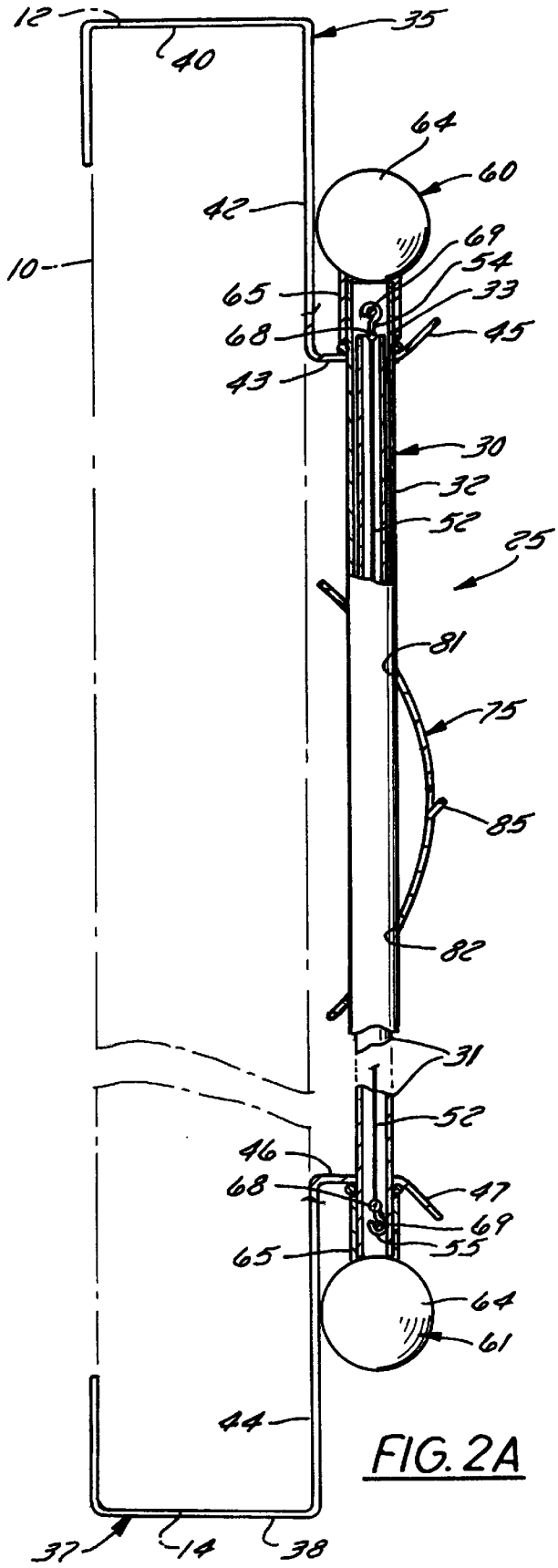
FIG. 2A is an enlarged side sectional view of the upper and lower ends of the pole system for displaying picture frames and showing the elastic cord, finial and one of the single sliding elements.

Finials 60 and 61 are best illustrated in the enlarged view FIG. 2A showing the upper and lower portions of the pole system for displaying picture frames 25. Each of the finials 60 and 61 include a decorative ball 64 and a collar 65 which extends about the respective ends of the pole sections 31 and 32. They may be adhered in place with an adhesive or with a set screw or the like. FIG. 2A also illustrates the attachment of a small hook 68 to the respective ends of the cord 52 and a post 69 to which the hook 68 is attached in a permanent manner.

Now that the pole components of the pole system for displaying picture frames 25 have been explained, it can be appreciated how the pole may be attached to an office panel 10. The pole sections 31 and 32 are pulled apart so that one of the brackets 35 or 37 is placed over an edge of the panel 10. The other end of the pole 30 is then pulled further away by an amount sufficient to have the U-shaped pocket of that end extend over the opposite edge, at which point the elastic cord is allowed to perform its function and draw the two brackets together to hold pole 30 in place under a tension load.

Figure 3:
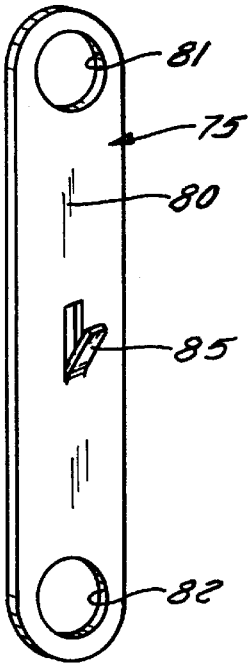
FIG. 3 is a perspective view of a plate sliding element used in the system of FIG. 1.

FIG. 2 also illustrates three sliding elements 75, 76 and 77 deployed at approximately equal distances along the length of pole 30. A sliding element 75 is shown in FIG. 3 to include a generally elongate plate 80 made from a resilient material and including a first opening 81 adjacent a first end and a second opening 82 adjacent the second end. Openings 81 and 82 are just slightly larger than the size of the pole 30 with which they will be used. Sliding element 75 also includes a hook 85 at its approximate mid-point, the shape and orientation of the hook is best appreciated by reference to FIG. 2A. Sliding element 75 is coupled to pole 30 by bending plate 80 so that a first one of hole openings 81 and 82 can be placed over the pole, followed by the second opening. It should then be appreciated that the plate 80 will, when released, attempt to return to its original flat condition, thereby locking the sliding element 75 at the location where the bending pressure is released. The sliding element 75 may be easily moved along the pole 30 by grasping the two ends of plate 80, urging them slightly toward one another in the curved configuration illustrated, sliding the element 75 to a new location and again releasing the bending forces on the plate 80.

Figure 5:
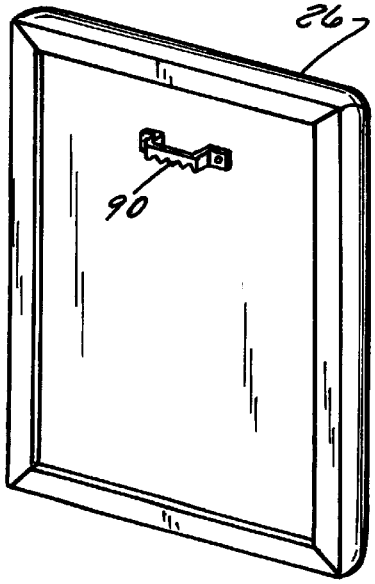
FIG. 5 is a partial schematic view of the rear of a picture frame showing one type of mounting bracket.

It will also now be appreciated how the picture frames 26 and 27 are attached to the pole system for displaying picture frames 26, 27 and 28. The hook 85 of the respective sliding elements 75, 76 and 77 may each be inserted into a receiving area on the back of the frames, preferably using a sawtooth bracket, which is well-known and which does not, in and of itself, form part of the present invention. A sawtooth bracket is illustrated in a partial drawing, FIG. 5. As indicated above, the use of a sawtooth bracket 90 is for purposes of illustration and a wire extending across the back of the picture frame could be placed over the hooks 85, or if a tab with holes was provided in the back of the frame, the hole could be placed over the hook, as would be well known by those familiar with the picture frame art.

Figure 4:
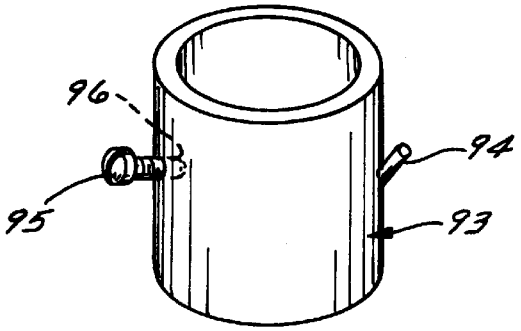
FIG. 4 is a perspective view of an alternative form of sliding element useful with the pole display system of the present invention.
Figure 4A:
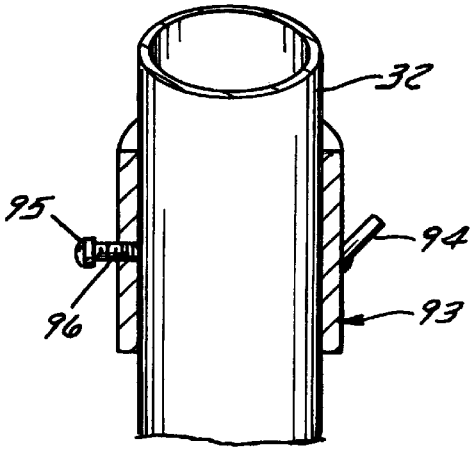
FIG. 4A is a partial schematic view of the sliding element of FIG. 4 displayed on a cylindrical pole.

An alternate form of sliding element is shown in FIG. 4, wherein a cylindrical sliding element 93 is provided on one side with a hook 94 and with a set screw 95 on the opposite side. The set screw is preferably hand manipulated and extends through a threaded opening 96 in the wall of cylindrical sliding element 93 so that the cylindrical sliding element 93 may be locked in any desired location along pole 30. FIG. 4A is a simplified, schematic showing a portion of pole section 32 extending through the cylindrical sliding element 93 and locked in place by the set screw 95.

Figure 6:
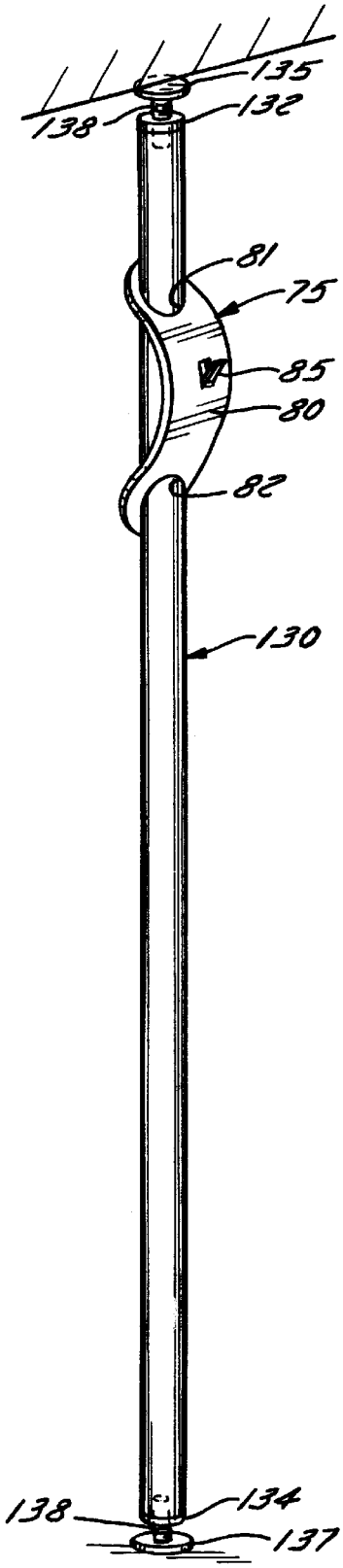
FIG. 6 is an alternate embodiment of the present invention in which a pole is held in a vertical orientation between the ceiling and the floor of a room and wherein a sliding element is deployed on the rod in the same manner as shown in FIG. 1.

Another embodiment of the invention is shown in partial form in FIG. 6. This view is provided to illustrate another way in which a pole 130 could be secured in a vertical position. A threaded washer is provided in each end of pole 130, an upper washer 132 and a lower washer 134. A pair of plates 135 and 137 having a diameter significantly greater than that of the pole 130 are also provided, and each includes a threaded bolt 138 extending perpendicularly from the center thereof. The thread configuration of the washers 132, 134 and rods 138 are selected to allow various lengths of the bolt 138 to be threaded into the hollow interior of the pole 130. This will allow the distance between the respective plates 135 and 137 to change. If the pole 130 is selected to generally correspond to the height of a room, the plates 135 and 137 can be rotated in appropriate directions to secure pole 130 into placed under a compressive load. The sliding elements are not shown in FIG. 6, but they could be of either of the types described above in connection with the other illustrated embodiments, or other sliding elements which can be moved along a pole and which can be secured in place easily and quickly.

While the present invention has been described in connection with a single preferred embodiment and several alternatives for the pole itself and for the sliding elements, the invention is not be limited thereby but is to be limited solely by the scope of the claims which follow.

What is claimed is:

1. A system for displaying picture frames adjacent an office furniture panel having upper and bottom edges comprising:

a pole comprising at least two telescoping sections and means for supporting the pole in a vertical position;

at least one sliding element coupled to the pole, which sliding element includes a connector adapted to engage and support a picture frame;

a picture frame for each element, each such frame supported from the connector of a sliding element; and the supporting means including U-shaped pockets for coupling the pole to the top and bottom edges of the office furniture panel.

2. The system of claim 1 wherein the pole is generally cylindrical.

3. The system of claim 1 wherein the pole includes at least two telescoping cylindrical sections.

4. The system of claim 3 wherein an elastic cord is provided within the pole sections and applies a tension force against the U-shaped pockets.

5. The system of claim 1 wherein the sliding element comprises an elongate plate having first and second ends and constructed from a resilient material, the plate including an opening adjacent each end, each plate opening being large enough to receive the pole therethrough, the plate being bent so that the pole extends through both plate openings and the connector being located between the two openings.

6. The system of claim 5 wherein the connector comprises a hook.

7. The system of claim 6 wherein the picture frame includes a sawtooth bracket on a rear side thereof which is engaged by the hook to support the picture frame.

8. The system of claim 1 wherein the sliding element comprises a collar slidable along the pole and a means for selectively locking the collar with respect to the pole.

9. The system of claim 8 wherein the pole is cylindrical and has an outer diameter, the collar is cylindrical and has an inner diameter slightly exceeding the outer diameter of the pole and the locking means is a set screw.

10. The system of claim 9 wherein the connector extends radially from the collar.

11. The system of claim 10 wherein the connector comprises a hook.

12. The system of claim 11 wherein the picture frame includes a sawtooth bracket on a rear side thereof which is engaged by the hook to support the picture frame.

13. A cubicle picture frame support system comprising:

a vertical office panel having upper and lower edges;

mounting brackets for each of the upper and lower edges, each bracket including an opening extending horizontally, the openings being coaxial;

a pole extending through the holes;

at least one sliding element on the pole and easily and quickly movable to selected positions along the pole, each sliding element including a connector for supporting a picture frame; and a picture frame having a rear side, the rear side including a coupler adapted to engage the connector so as to support the picture frame.

14. The system of claim 13 wherein the pole includes at least two telescoping hollow sections.

15. The system of claim 14 further comprising an elastic cord within the pole sections which holds the mounting brackets onto the panel by tension force.

16. The system of claim 13 wherein the sliding element comprises an elongate plate having first and second ends constructed from a resilient material, the plate including an opening adjacent each end, each plate opening being large enough to receive the pole therethrough, the plate being bent so that the pole extends through both plate openings and the connector being located between the two plate openings.

17. The system of claim 13 wherein the sliding element comprises a collar and a means for selectively locking the collar with respect to the pole.

* * * * *